US008634750B2

(12) United States Patent
Noso et al.

(10) Patent No.: US 8,634,750 B2
(45) Date of Patent: Jan. 21, 2014

(54) CAM DRIVING MECHANISM, AND BELT TRANSPORTING APPARATUS AND IMAGE FORMING APPARATUS THEREWITH

(75) Inventors: Terumitsu Noso, Osaka (JP); Yoshitaka Tokoro, Osaka (JP); Lin Lu, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 327 days.

(21) Appl. No.: 13/116,109

(22) Filed: May 26, 2011

(65) Prior Publication Data

US 2011/0293336 A1 Dec. 1, 2011

(30) Foreign Application Priority Data

May 31, 2010 (JP) ..... 2010-124853

(51) Int. Cl.
*G03G 15/01* (2006.01)

(52) U.S. Cl.
USPC ..... 399/302; 399/312

(58) Field of Classification Search
USPC ..... 399/165, 302, 308, 312; 198/813, 198/810.01
See application file for complete search history.

(56) References Cited

U.S. PATENT DOCUMENTS 7,263,321 B2 * 8/2007 Inui et al. ..... 399/302
7,406,282 B2 * 7/2008 Inui et al. ..... 399/302
7,460,820 B2 * 12/2008 Okabe ..... 399/302
7,657,214 B2 * 2/2010 Inui et al. ..... 399/302
2012/0039640 A1 * 2/2012 Kang ..... 399/302

FOREIGN PATENT DOCUMENTS

JP 63185758 A * 8/1988
JP 6-56294 3/1994
JP 2005-292480 10/2005
JP 2008-105837 5/2008

* cited by examiner

*Primary Examiner* — Susan Lee
(74) *Attorney, Agent, or Firm* — Smith, Gambrell & Russell, LLP

(57) ABSTRACT

A cam driving mechanism has: a cam; a motor which drives the cam; a gear train which transmits, while reducing the speed of, the output of the motor to the cam; a pulse disk which is formed integrally with a gear coupled in the gear train and in which a plurality of slits are formed at equal intervals; a home position detecting member which is arranged coaxially with the pulse disk so as to be rotatable independently thereof and which, by meshing with another gear coupled in the gear train, rotates at a lower rotation speed than the pulse disk; and a cam position detecting sensor which has a detecting portion including a light-emitting portion and a light-receiving portion, the cam position detecting sensor detecting the amount of driving of the cam based on the number of slits of the pulse disk that have passed through the detecting portion, the cam position detecting sensor detecting the home position of the cam based on the timing with which the home position detecting member shields the detecting portion.

10 Claims, 7 Drawing Sheets

CAM DRIVING MECHANISM, AND BELT TRANSPORTING APPARATUS AND IMAGE FORMING APPARATUS THEREWITH

This application is based on Japanese Patent Application No. 2010-124853 filed on May 31, 2010, the contents of which are hereby incorporated by reference.

BACKGROUND OF THE INVENTION

1. Field of the Invention

The present invention relates to a cam driving mechanism for driving a cam, a belt transporting apparatus provided therewith for rotating an endless belt such as a transport belt or an intermediary transfer belt, and an image forming apparatus provided therewith.

2. Description of Related Art

Various types of image forming apparatuses have been conventionally proposed. In one type of image forming apparatus, there are provided an endless transport belt rotated in a predetermined direction and an image forming section arranged along the transport belt, and a toner image formed by the image forming section is transferred onto a recording medium transported by the transport belt. In another type of image forming apparatus, one toner image after another are sequentially formed on an endless intermediary transfer belt by a plurality of image forming sections and then these toner images are transferred onto a recording medium all at once.

In image forming apparatuses that employ an endless transport or intermediary transfer belt as mentioned above, improper arrangement, that is, so-called misalignment, of a belted roller such as a drive roller or a tension roller ascribable to strain in the apparatus body may lead to meandering or lopsiding of a transport belt. Meandering or lopsiding of the transport belt causes the transported paper to be displaced sideways (left or right), and thus makes displacement of the transferred image more likely.

In the case of tandem-type color image forming apparatuses which form a color image by operating a plurality of image forming sections, meandering or lopsiding of the transport belt degrades the positioning of the images of different colors formed by the individual image forming sections relative to one another, and thus makes color displacement among the toner images of the different colors more likely. Also in image forming apparatuses of the intermediary transfer type, meandering of the intermediary transfer belt causes similar problems.

In conventional belt transporting apparatuses, meandering or lopsiding of a belt is detected by a sensor, and according to the amount of meandering or lopsiding, the alignment of one or more belted rollers (their angle in the obverse/reverse direction of the belt) is adjusted, so that the meandering or lopsiding is automatically corrected. And a common method of adjusting the alignment of a belted roller is changing the rotation angle of an eccentric cam or moving distance of a linear motion cam by using a pinion and rack mechanism, which swings one end of the rotary shaft of the belted roller.

For accurate alignment adjustment using a cam, for example, according to one known method, the amount of driving of the motor for rotating or moving a cam is changed in accordance with the amount of displacement of the cam per unit angle or distance; according to another known method, a cam is used that is so shaped that the meandering speed of the belt is increased or decreased at a predetermined rate according to the rotation angle so as to constantly keep equal the rotation angle or moving distance of the cam and the amount of meandering corrected.

In a case where alignment adjustment is achieved by changing the rotation angle or moving distance of the cam as described above, the amount of driving of the motor for rotating or moving the cam needs to be controlled accurately. For that purpose, according to a known method, a home position flag is provided at the end of the output shaft of a steering motor opposite from the end thereof at which the cam is provided, and by detecting the phase of the flag by a home position sensor, the phase of the rotation cam is detected; in addition, based on information on the output voltage of a belt edge sensor, the number of drive pulses for the steering motor is determined; thus the rotation angle or moving distance of the cam is controlled In a case where alignment adjustment is achieved by using a stepping motor as the motor for rotating the eccentric cam or moving the linear motion cam, the position (rotation angle or moving distance) of the cam can be controlled according to the number of drive pulses transmitted to the motor; however, in a case where a brush motor is used as a cheap alternative to a stepping motor, which is expensive, controlling the amount of driving of the motor requires position detecting means for detecting the position (rotation angle or moving distance) of the cam and home position detecting means for detecting the reference position (home position) relative to which the cam is rotated.

Here, attempting to detect both the cam position and the reference position with a single member (pulse disk) inconveniently leads to the pulse disk having low resolution and hence low detection accuracy, making accurate adjustment of roller alignment impossible. On the other hand, detecting them with separate members requires a large space for arrangement of detection-related components as well as two separate sensors for detection of the cam position and the home position, disadvantageously for size reduction and cost reduction of the apparatus.

Although the foregoing discusses, as an example, a driving mechanism for a cam used for alignment adjustment of a belted roller on which an endless belt is wound, similar problems have also been encountered with other types of cam driving mechanism that adjust the amount of displacement of a member on the basis of the phase of a cam.

SUMMARY OF THE INVENTION

An object of the present invention is to provide a cam driving mechanism that can detect the reference position and the position of a cam accurately with a compact construction, a belt transporting apparatus provided therewith that can correct meandering of an endless belt, and an image forming apparatus provided therewith.

To achieve the above object, according to one aspect of the present invention, a cam driving mechanism is provided with: a cam; a motor which drives the cam; a gear train which transmits, while reducing speed of, an output of the motor to the cam; a pulse disk which is formed integrally with a gear coupled in the gear train and in which a plurality of slits are formed at equal intervals; a home position detecting member which is arranged coaxially with the pulse disk so as to be rotatable independently thereof and which, by meshing with another gear coupled in the gear train, rotates at a lower rotation speed than the pulse disk; and a cam position detecting sensor which has a detecting portion including a light-emitting portion and a light-receiving portion, the cam position detecting sensor detecting the amount of driving of the cam based on the number of slits of the pulse disk that have passed through the detecting portion, the cam position detecting sensor detecting the home position of the cam based on the timing with which the home position detecting member shields the detecting portion.

The further objects of the invention, and the specific benefits of the invention, will be clear from the following description of embodiments of the invention.

DETAILED DESCRIPTION OF PREFERRED EMBODIMENTS

Figure 1:
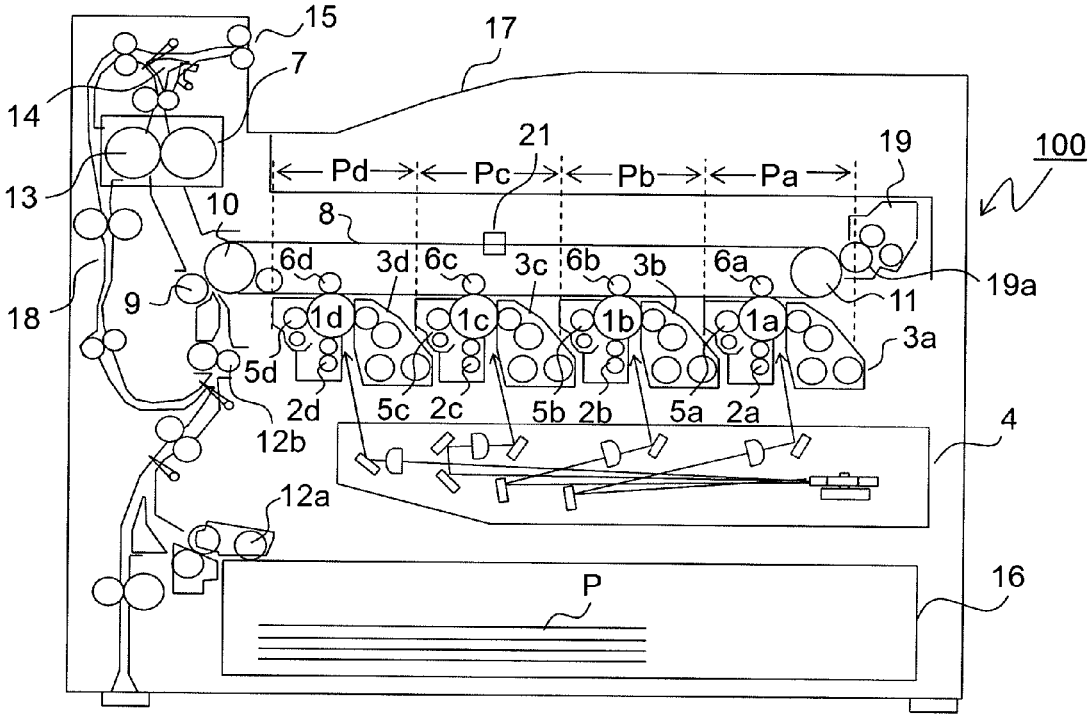
FIG. 1 is a schematic diagram showing the internal construction of an image forming apparatus according to a first embodiment which is provided with a belt transporting apparatus embodying the invention.

Embodiments of the present invention will be described below with reference to the accompanying drawings. FIG. 1 is a schematic diagram showing the construction of an image forming apparatus according to a first embodiment which is provided with a belt transporting apparatus embodying the invention. This embodiment deals with a belt transporting apparatus for an intermediary transfer belt in a tandem-type color image forming apparatus.

The image forming apparatus 100 shown in FIG. 1 is constructed in the following manner. Inside the cabinet of the image forming apparatus 100, four image forming sections Pa, Pb, Pc, and Pd are arranged in this order from upstream (the right side in FIG. 1) with respect to the transport direction. These image forming sections Pa, Pb, Pc, and Pd correspond to images of four different colors (cyan, magenta, yellow, and black), and form a cyan, a magenta, a yellow, and a black image sequentially, each through the processes of charging, exposure, development, and transfer.

In the image forming sections Pa, Pb, Pc, and Pd, photoconductive drums 1*a*, 1*b*, 1*c*, and 1*d* are respectively arranged which carry visible images (toner images) of the different colors. In addition, an intermediary transfer belt 8 which is rotated clockwise in FIG. 1 by driving means (not illustrated) is provided adjacent to the image forming sections Pa to Pd. The toner images formed on the photoconductive drums 1*a* to 1*d* are sequentially transferred onto the intermediary transfer belt 8 which moves while in contact with the photoconductive drums 1*a* to 1*d*, and are thereafter transferred, all at once, onto transfer paper P as an example of a recording medium by a secondary transfer roller 9. The images are then fixed on the transfer paper P by a fixing section 7, and the paper P is thereafter ejected out of the apparatus cabinet. While the photoconductive drums 1*a* to 1*d* are rotated counter-clockwise in FIG. 1, an image forming process is performed with respect to each of them.

The transfer paper P to which the toner images are transferred is originally accommodated in a paper cassette 16 in a lower part of the cabinet of the image forming apparatus 100, and is transported therefrom to the secondary transfer roller 9 via a paper feed roller 12*a* and a pair of resist rollers 12*b*. As the intermediary transfer belt 8, a sheet of a dielectric resin is used, and typically a belt without a seam (seamless belt) is used.

Next, the image forming sections Pa to Pd will be described. Around and under the photoconductive drums la to 1*d* which are rotatably arranged, there are arranged: chargers 2*a*, 2*b*, 2*c*, and 2*d* for electrically charging the photoconductive drums 1*a* to 1*d*; an exposure unit 4 for forming electrostatic latent images on the photoconductive drums 1*a* to 1*d* through exposure thereof to light conveying image information; developing units 3*a*, 3*b*, 3*c*, and 3*d* for developing the electrostatic latent images formed on the photoconductive drums 1*a* to 1*d* to form toner images; and cleaning devices 5*a*, 5*b*, 5*c*, and 5*d* for removing the developer (toner) remaining on the photoconductive drums 1*a* to 1*d*.

When the user enters an instruction to start image formation, first, the chargers 2*a* to 2*d* electrically charge the surfaces of the photoconductive drums 1*a* to 1*d* uniformly; next, the exposure unit 4 irradiates the surfaces of the photoconductive drums 1*a* to 1*d* with light according to image data to form electrostatic latent images according to the image data on the photoconductive drums 1*a* to 1*d*. The developing units 3*a* to 3*d* contain predetermined amounts of cyan, magenta, yellow, and black toner respectively by being fed therewith by toner feeding devices (not illustrated). The developing units 3*a* to 3*d* supply the toner onto the photoconductive drums 1*a* to 1*d* to let it electrostatically adhere thereto, thus forming toner images according to the electrostatic latent images formed through exposure to light from the exposure unit 4.

Then, primary transfer rollers 6*a* to 6*d* which are arranged so as to press against the photoconductive drums 1*a* to 1*d* across the intermediary transfer belt 8 apply an electric field with a predetermined transfer voltage between the primary transfer rollers 6*a* to 6*d* and the photoconductive drums 1*a* to 1*d*, and thereby the cyan, magenta, yellow, and black toner images on the photoconductive drums 1*a* to 1*d* are primarily transferred onto the intermediary transfer belt 8. These images of four colors are formed in a predetermined positional relationship prescribed for formation of a predetermined full-color image. Thereafter, in preparation for formation of new electrostatic latent images to be formed subsequently, the toner remaining on the surfaces of the photoconductive drums 1*a* to 1*d* after primary transfer is removed by the cleaning devices 5*a* to 5*d*.

The intermediary transfer belt 8 is wound around and between a drive roller 10, which is arranged downstream, and a tension roller 11, which is arranged upstream. When a driving motor (not illustrated) starts to rotate the drive roller 10 and as a result the intermediary transfer belt 8 starts to rotate clockwise in FIG. 1, the transfer paper P is transported from the pair of resist rollers 12*b* to the nip portion (secondary transfer nip portion) between the drive roller 10 and the secondary transfer roller 9 arranged adjacent thereto with predetermined timing, so that the full-color toner image is transferred. Having the toner images transferred onto it, the transfer paper P is then transported to a fixing section 7.

Upstream of the image forming section Pa with respect to the movement direction of the intermediary transfer belt 8, there is arranged a belt cleaning unit 19 for removing the toner remaining on the surface of the intermediary transfer belt 8. Further downstream of the drive roller 10, there is arranged a meandering detecting sensor 21 for detecting meandering of the intermediary transfer belt 8. The meandering detecting sensor 21 is so arranged that a U-shaped detecting portion thereof, which is provided with a light-emitting portion and a light-receiving portion (not illustrated), faces an edge part of the intermediary transfer belt 8 from both the obverse and reverse sides thereof. The meandering detecting sensor 21 detects the position of the edge part based on the position at which the optical path from the light-emitting portion to the light-receiving portion is obstructed by the edge part, and is thereby capable of detecting the direction and amount of the meandering of the intermediary transfer belt 8.

The transfer paper P transported to the fixing section 7 then has heat and pressure applied to it by a pair of fixing rollers 13 so that the toner images are fixed on the surface of the transfer paper P and thus the predetermined full-color image is formed on the transfer paper P. Having the full-color image formed thereon, the transfer paper P is then directed into the desired transport direction by a branching section 14 which branches into a plurality of directions. In a case where the transfer paper P is being subjected to single-side image formation, it is then immediately ejected into an ejection tray 17 by ejection rollers 15.

On the other hand, in a case where the transfer paper P is being subjected to double-side image formation, first, the part of the transfer paper P that has passed the fixing section 7 is let out of the apparatus via the ejection rollers 15. Then, after the rear end of the transfer paper P has passed the branching section 14, the ejection rollers 15 is rotated backward and the transport direction of the branching section 14 is switched. This causes the transfer paper P to be directed, from its rear end, into a paper transport path 18 so that the transfer paper P is then, with the image surface reversed, transported to the secondary transfer nip portion once again. Then, the secondary transfer roller 9 transfers the next image formed on the intermediary transfer belt 8 onto the surface of the transfer paper P where no image has been formed yet. The transfer paper P is then transported to the fixing section 7, where the toner images are fixed, and is then ejected into the ejection tray 17.

Figure 2:
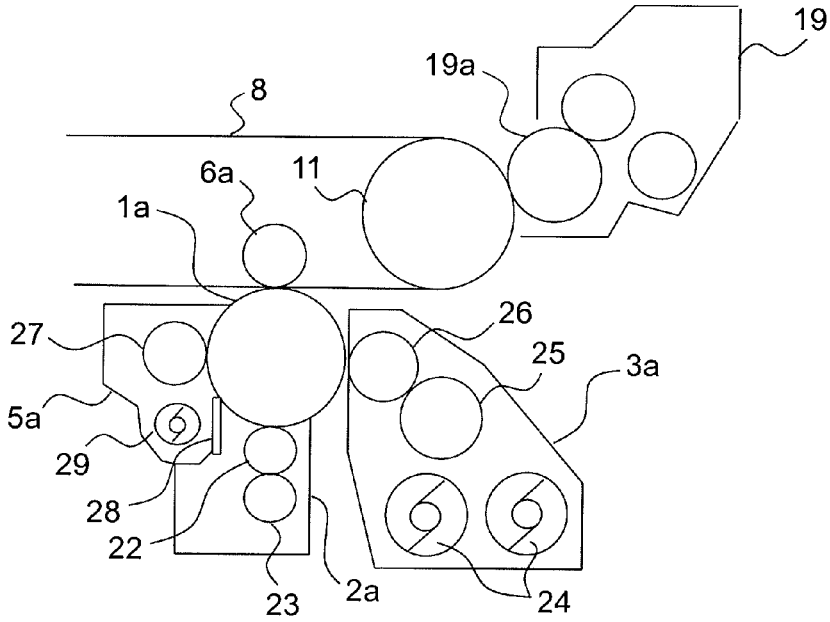
FIG. 2 is an enlarged view of a part of FIG. 1 around the image forming section Pa.

FIG. 2 is an enlarged view of a part of FIG. 1 around the image forming section Pa. Since the construction around the other image forming sections Pb to Pd is basically similar, no overlapping description will be repeated. Around the photoconductive drum 1*a*, there are arranged, along the drum rotation direction (counter-clockwise in FIG. 2), a charger 2*a*, a developing unit 3*a*, and a cleaning device 5*a*, and, across the intermediary transfer belt 8, a primary transfer roller 6*a*. Moreover, upstream of the photoconductive drum 1*a* with respect to the rotation direction of the intermediary transfer belt 8, there is arranged a belt cleaning unit 19 which is provided with a belt cleaning roller 19*a* which faces the tension roller 11 across the intermediary transfer belt 8.

The charger 2*a* has a charge roller 22, which makes contact with the photoconductive drum 1*a* to apply a charge bias to the surface thereof, and a charge cleaning roller 23 for cleaning the charge roller 22. The developing unit 3*a* has two stirring-conveying screws 24, a magnetic roller 25, and a developing roller 26. Applying a developing bias of the same polarity (positive) as toner to the developing roller 26 makes the toner fly onto the drum surface.

The cleaning device 5*a* has a rubbing roller 27, a cleaning blade 28, and a collecting screw 29. The rubbing roller 27 is pressed against the photoconductive drum 1*a* with a predetermined pressure, and is rotated by unillustrated driving means in the same direction as the photoconductive drum 1*a* at the plane of contact therewith, with the peripheral speed of the rubbing roller 27 controlled to be higher than (here 1.2 times) that of the photoconductive drum 1*a*. As the rubbing roller 27, for example, a structure is used in which a foamed material layer of EPDM rubber with a hardness of 55 degrees on Asker C scale is formed as a roller member around a metal shaft. The material of the roller member is not limited to EPDM rubber; any other rubber material or foamed rubber member may be used, a suitable range of hardness being 10 to 90 degrees on Asker C scale.

In a part of the surface of the photoconductive drum 1*a* downstream of the plane of contact with the rubbing roller 27 with respect to the rotation direction, the cleaning blade 28 is fixed in contact with the photoconductive drum 1*a*. As the cleaning blade 28, for example, a blade of polyurethane rubber with a JIS hardness of 78 degrees is used, and is fitted at a predetermined angle with respect to the direction of the tangent line to the photoconductive drum 1*a* at the point of contact. With respect to the cleaning blade 28, its material, hardness, dimensions, edge overlap (trail) on the photoconductive drum 1*a*, pressing force, etc. are set appropriately according to the specifications of the photoconductive drum 1*a*.

The remaining toner removed from the surface of the photoconductive drum 1*a* by the rubbing roller 27 and the cleaning blade 28 is, as the collecting screw 29 rotates, discharged out of the cleaning device 5*a*, and is transported to a toner collection container (not illustrated) to be stored there. The toner used in the present invention is, for example, a type in which silica, titanium oxide, strontium titanate, alumina, or the like is embedded as an abrasive in the surface of toner particles so as to partly protrude therefrom, or a type in which an abrasive is electrostatically adhered to the toner surface.

Figure 3:
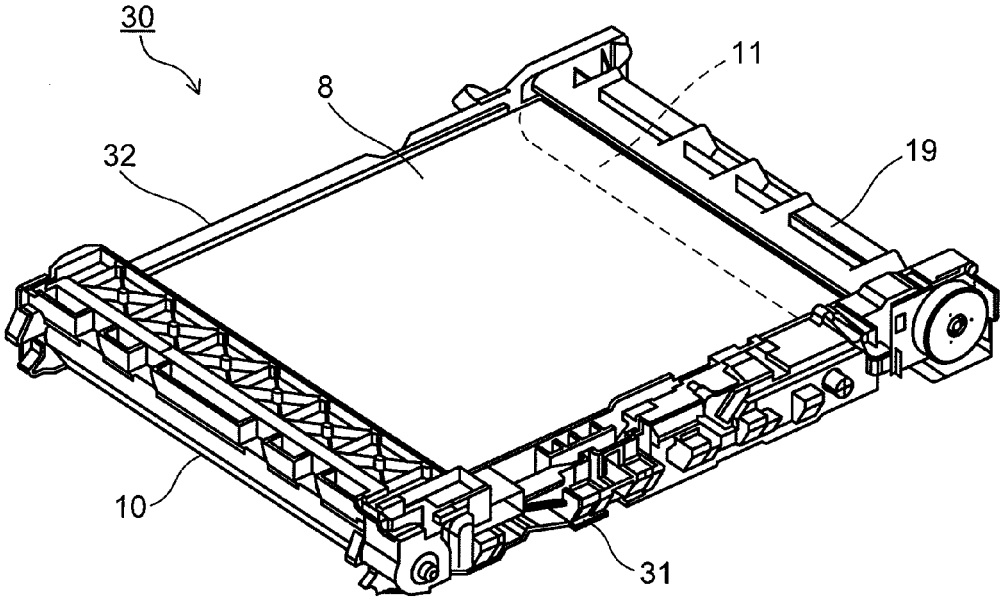
FIG. 3 is an exterior perspective view of a belt transporting apparatus embodying the invention.

FIG. 3 is an exterior perspective view of the belt transporting apparatus in the image forming apparatus shown in FIG. 1. Such parts as are shown in FIG. 1 are identified by the same reference signs, and no overlapping description will be repeated. FIG. 3 shows the belt transporting apparatus as seen from the top side of FIG. 1. In the belt transporting apparatus 30, a plurality of belted rollers including the drive roller 10 and the tension roller 11 are supported between two support frames 31 and 32, and the intermediary transfer belt 8 is wound around those rollers. At the end of the support frames 31 and 32 adjacent to the tension roller 11, the belt cleaning unit 19 is attached.

Figure 4:
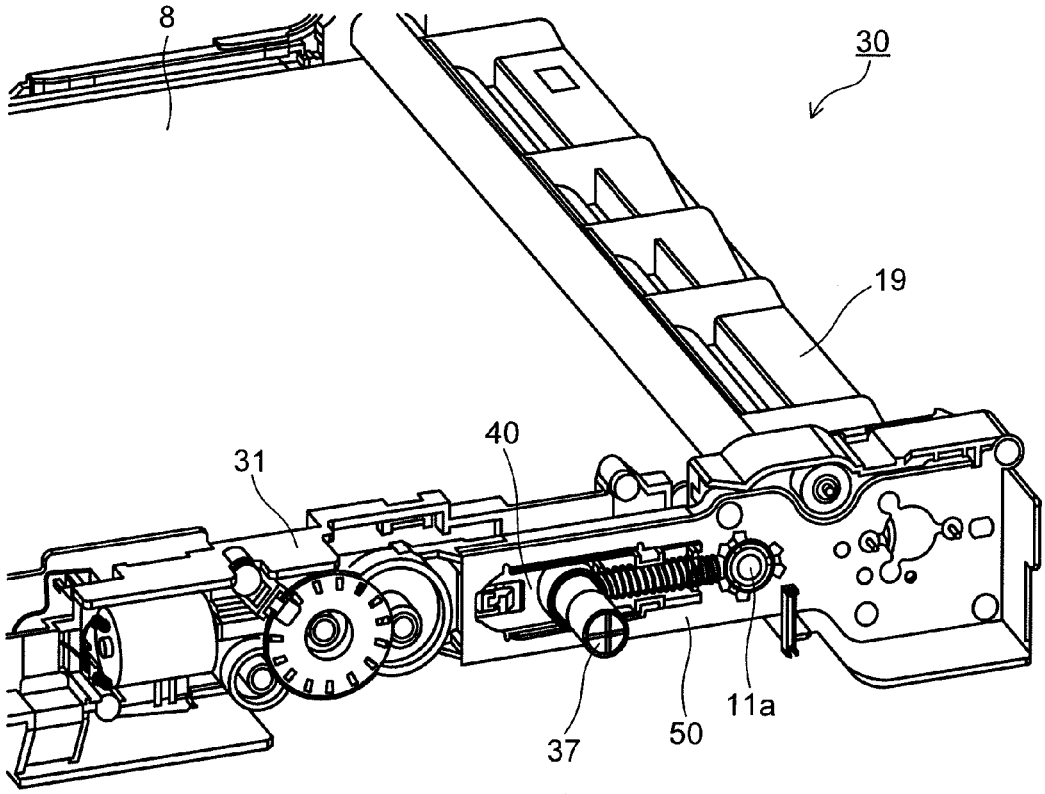
FIG. 4 is an enlarged perspective view of a near-side part of FIG. 3 around the rotary shaft of the tension roller.

FIG. 4 is an enlarged perspective view of a near-side part of FIG. 3 around the rotary shaft of the tension roller 11. FIG. 4 shows a state in which part of the members that are ordinarily mounted on the support frame 31 are dismounted. The support frame 31 has a pivot 37 formed thereon so as to protrude therefrom, and is fitted with an arm member 40 of a resin which is swingable about the pivot 37. The arm member 40 slidably holds a slide member 50 of sheet metal which supports the rotary shaft 11*a* of the tension roller 11. The arm member 40, the slide member 50, and a compression spring 60 (described later; see FIG. 5) together constitute a tension mechanism which applies a predetermined tensile force to the tension roller 11. The belt cleaning unit 19 is fixed to the slide member 50.

Figure 5:
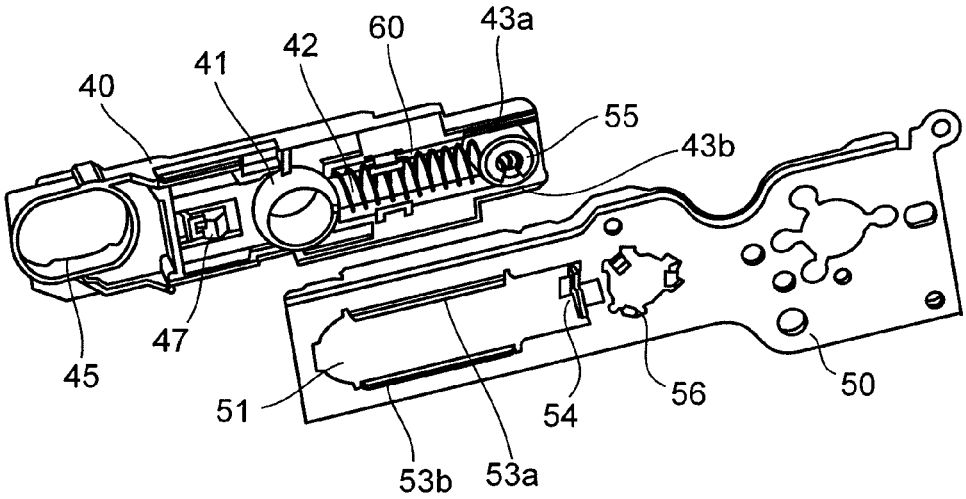
FIG. 5 is a perspective view showing, in a dismounted state, the arm member 40 and the slide member 50 mounted on the near-side support frame 31 in FIG. 3.

FIG. 5 is a perspective view showing, in a dismounted state, the arm member 40 and the slide member 50 mounted on the near-side support frame 31 in FIG. 3. In a substantially central part of the arm member 40, a cylindrical bracket 41 is formed into which the pivot 37 is rotatably inserted. Around a boss 42 formed on the side surface of the bracket 41, one end of a compression spring 60 is fitted under pressure. Moreover, first guide ribs 43*a* and 43*b* which make contact with the outer peripheral surface of a bearing member 55 fixed to the slide member 50 are formed so as to face the compression spring 60 from above and below.

In a part of the arm member 40 on the opposite side of the bracket 41 from the compression spring 60, an oval cam hole 45 is formed with whose inner peripheral surface a rotary cam 77 (see FIG. 7) of an alignment adjustment mechanism makes contact. Between the bracket 41 and the cam hole 45, a hook-shaped holding portion 47 is provided which holds the slide member 50 so that it does not come off when the arm member 40 and the slide member 50 are assembled together.

In the slide member 50, an oval opening 51 is formed with which the bracket 41 of the arm member 40 engages. Along the upper and lower edges of the opening 51, second guide ribs 53*a* and 53*b* are formed which make contact with the outer peripheral surface of the bracket 41, and at the end of the opening 51 located toward the tension roller 11, a spring base 54 is formed to which the other end of the compression spring 60 is fitted. At one end of the slide member 50, a bearing member 55 is fixed into which the rotary shaft 11*a* of the tension roller 11 is inserted. The bearing member 55 is designed to have an external diameter substantially equal to the external diameter of the bracket 41. Although in FIG. 5, to show the positional relationship between the first guide ribs 43*a* and 43*b* and the bearing member 55, the bearing member 55 is shown to be located on the arm member 40, in reality the bearing member 55 is fixed on the slide member 50 by locking claws 56.

Figure 6:
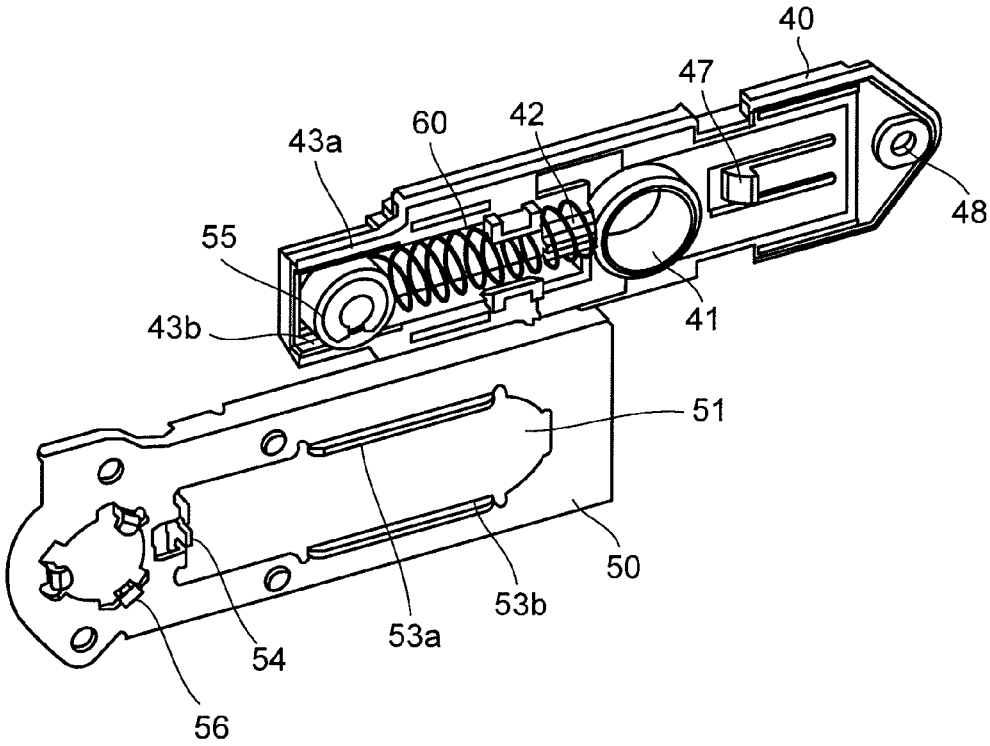
FIG. 6 is a perspective view showing, in a dismounted state, the arm member 40 and the slide member 50 mounted on the far-side support frame 32 in FIG. 3.

FIG. 6 is a perspective view showing, in a dismounted state, the arm member 40 and the slide member 50 mounted on the far-side support frame 32 in FIG. 3. In the arm member 40 mounted on the support frame 32, no cam hole 45 is formed, and instead a screw hole 48 is formed for fixing the arm member 40 to the support frame 32. The belt cleaning unit 19 (see FIG. 4) is fixed to the slide member 50 via another member of sheet metal. In other respects, the construction here is similar to that around the arm member 40 and the slide member 50 mounted on the support frame 31 shown in FIG. 5, and therefore no overlapping description will be repeated. Although also in FIG. 6, the bearing member 55 is shown to be located on the arm member 40, in reality the bearing member 55 is fixed on the slide member 50 by locking claws 56.

Figure 7:
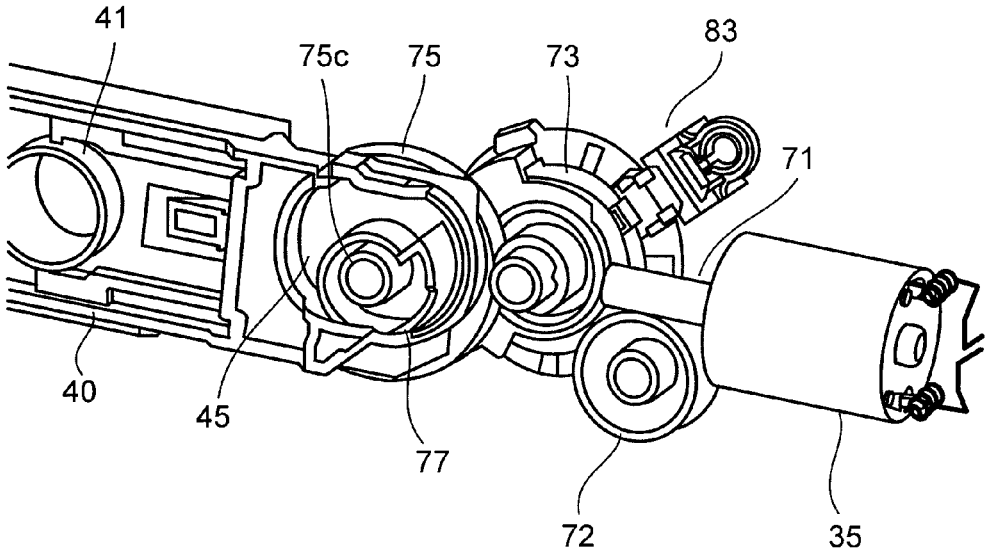
FIG. 7 is a perspective view of the alignment adjustment mechanism for the tension roller, as seen from inside the belt transporting apparatus.
Figure 8:
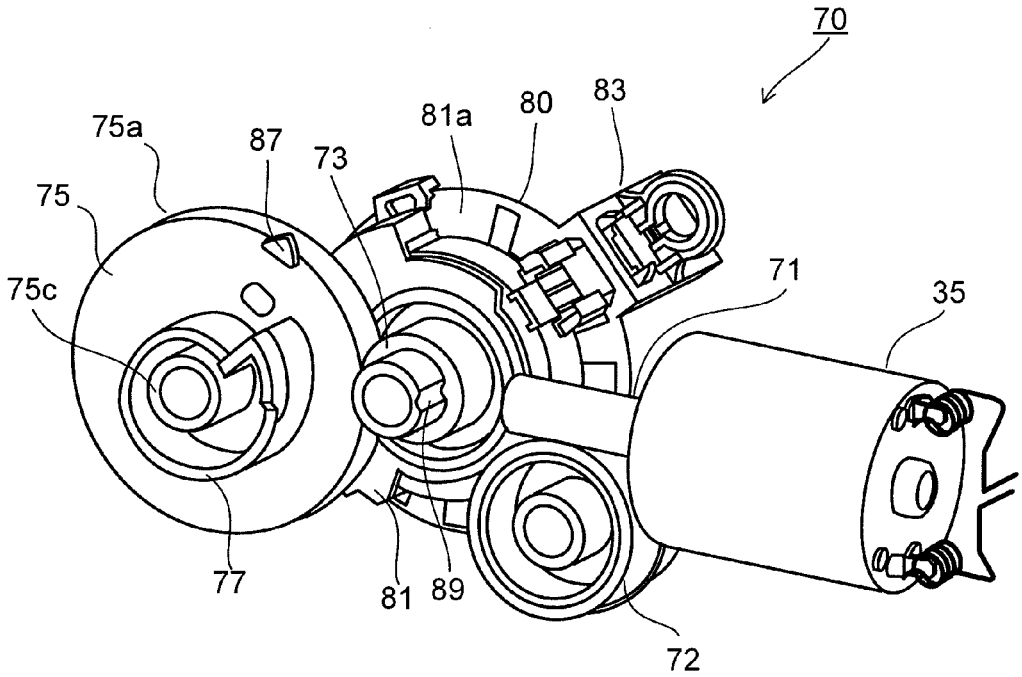
FIG. 8 is a perspective view of a cam driving mechanism embodying the invention which is provided in the alignment adjustment mechanism, as seen from inside the belt transporting apparatus.
Figure 9:
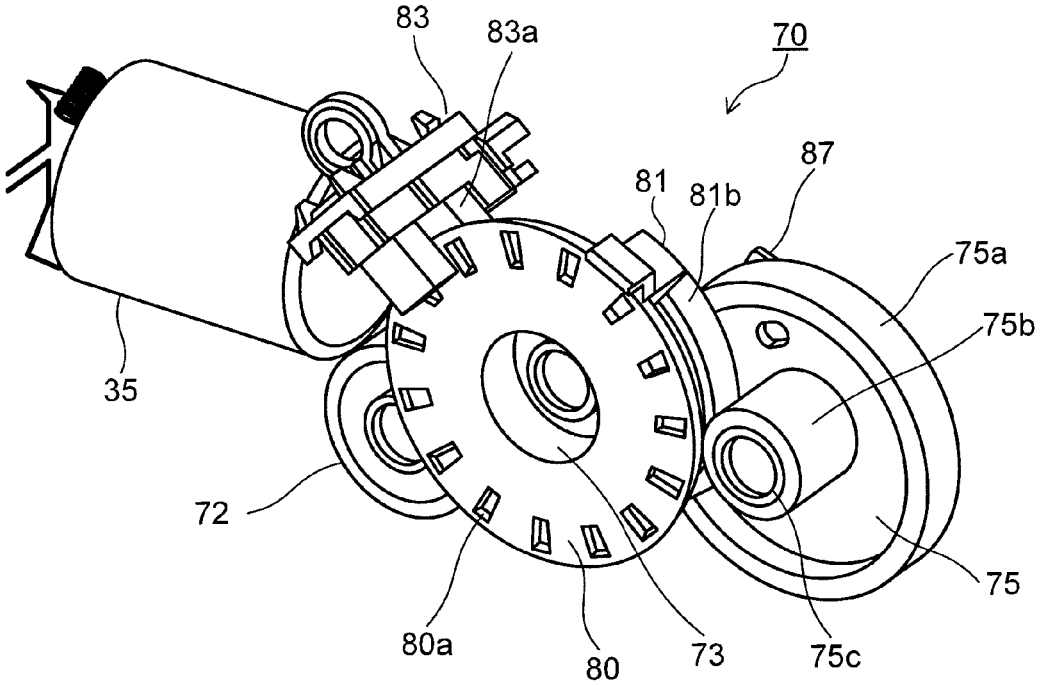
FIG. 9 is a perspective view of the cam driving mechanism embodying the invention, as seen from outside the belt transporting apparatus.

FIG. 7 is a perspective view of the alignment adjustment mechanism for the tension roller as seen from inside the belt transporting apparatus, and FIGS. 8 and 9 are partial perspective views of the cam driving mechanism provided in the alignment adjustment mechanism as seen from inside and outside the belt transporting apparatus. The cam driving mechanism 70 is composed of: an alignment adjustment motor 35 which is fixed to the support frame 31; a worm gear 71 which is fixed to the output shaft of the alignment adjustment motor 35; a worm wheel 72 on which cogs meshing with the worm gear 71 are formed; a multiple gear 73 which meshes with the worm wheel 72; a double gear 75 which has a large-diameter portion 75*a* meshing with the multiple gear 73 and a small-diameter portion 75*b*; and a rotary cam 77 which is formed integrally with the double gear 75 about the rotary shaft 75*c* thereof. The rotary cam 77 has a cam surface to which a distance of radial direction from a rotary shaft 75*c* changes along the rotational direction. The rotary cam 77 is arranged so as to make contact with the inner peripheral surface of the cam hole 45 formed in the arm member 40.

When the meandering detecting sensor 21 (see FIG. 1) detects meandering of the intermediary transfer belt 8, a detection signal is transmitted to a control section (not illustrated), and in the control section, the direction and amount of the meandering of the intermediary transfer belt 8 are calculated. The control section then transmits a control signal to the alignment adjustment motor 35 so that, via the worm gear 71, the worm wheel 72, and the multiple gear 73, the rotary cam 77 is rotated in a predetermined direction by a predetermined amount.

This causes the distance from the rotation center (rotary shaft 75*c*) to the outer peripheral surface of the rotary cam 77, which is in contact with the inner peripheral surface of the cam hole 45, to change, and as a result the arm member 40 swings up or down about the bracket 41; accordingly, the slide member 50, which is fixed to the arm member 40, swings up or down by a predetermined angle. Thus, one end of the rotary shaft 11*a* of the tension roller 11 swings together with the slide member 50, and this makes it possible to incline the intermediary transfer belt 8 wound around the tension roller 11 by a predetermined angle and thereby correct the meandering.

For example, in a case where the intermediary transfer belt 8 is meandering toward the front of the apparatus (toward the near side in FIG. 3), the rotary cam 77 is rotated clockwise in FIG. 8 so that the front-side end of the tension roller 11 moves up by a predetermined amount. This makes the intermediary transfer belt 8 incline with a downward slope from the near side to the far side of FIG. 3; thus, as the intermediary transfer belt 8 rotates, it moves increasingly far, and thereby the meandering toward the near side is corrected. In a case where the intermediary transfer belt 8 is meandering toward the far side of the apparatus, the rotary cam 77 is rotated in the reverse direction (counter-clockwise in FIG. 8) so that the front-side end of the tension roller 11 moves down by a predetermined amount. This makes the intermediary transfer belt 8 incline with an upward slope from the near side to the far side.

In the manner described above, meandering of the intermediary transfer belt 8 can be corrected accurately. Thus, in an image forming apparatus of the intermediary transfer type, where toner images of different colors are first transferred onto the intermediary transfer belt 8 sequentially over one another to form a color image and are then transferred onto transfer paper P all at once, it is possible to obtain a remarkable effect of preventing color dislocation and further obtain an effect of preventing image distortion at left and right parts of the belt.

As shown in FIG. 9, with the multiple gear 73, a pulse disk 80 is integrally formed which has a number of slits 80*a* formed at equal intervals therein for detecting the position (rotation angle) of the rotary cam 77. The multiple gear 73 is provided with a bearing surface where no cogs are formed, and on this bearing surface, a home position detecting member 81 for detecting the reference position (home position) of the rotary cam 77 is rotatably supported. On the outer peripheral surface of the home position detecting member 81, cogs 81*b* are formed which mesh with the small-diameter portion 75*b* of the double gear 75.

Moreover, obliquely over the multiple gear 73, a cam position detecting sensor 83 is arranged for detecting the home position and cam position (rotation angle) of the rotary cam 77. The cam position detecting sensor 83 is a PI (photointerruptor) sensor similar to the meandering detecting sensor 21, and is so arranged that a U-shaped detecting portion 83*a* thereof, which is provided with a light-emitting portion and a light-receiving portion, faces an edge part of the pulse disk 80 and home position detecting member 81 from both the obverse and reverse sides thereof.

In the above construction, as the multiple gear 73 rotates, the pulse disk 80 and the home position detecting member 81 rotate in the same direction as the multiple gear 73 but at mutually different speeds. Here, the gear ratio between the multiple gear 73 and the double gear 75 is so set that the rotation speed of the home position detecting member 81 is 1/9 (one-ninth) of the rotation speed of the pulse disk 80. The phases of the multiple gear 73, the double gear 75, and the home position detecting member 81 are so adjusted that, when a light-shielding portion 81*a* turns the state of the optical path of the detecting portion 83*a* from open to shielded, the rotary cam 77 is at its home position. Moreover, here, the position at which the part of the rotary cam 77 where it is smallest in diameter makes contact with the cam hole 45 of the arm member 40 is taken as the home position.

Figure 10:
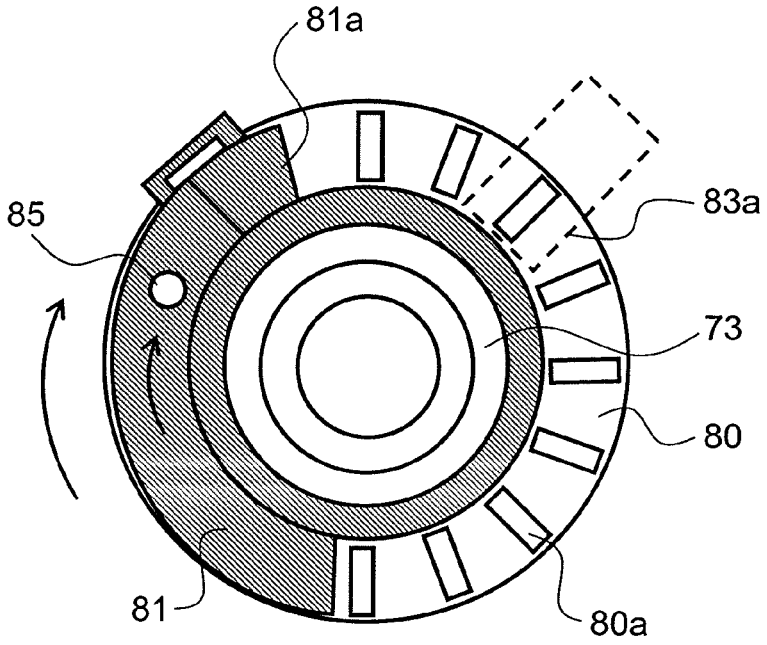
FIG. 10 is a front view showing the relationship between the pulse disk and the home position detecting member before detection of the home position of the rotary cam.
Figure 11:
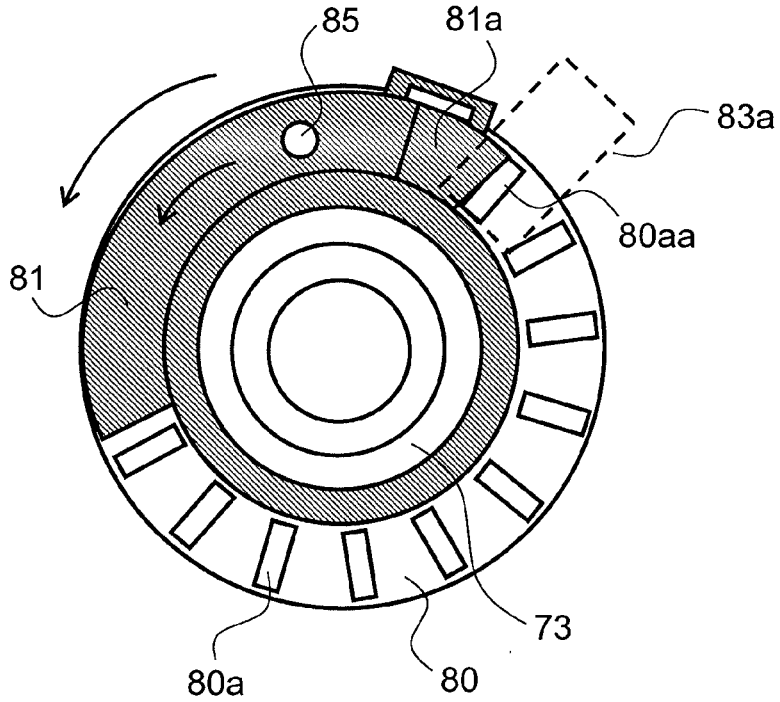
FIG. 11 is a front view showing the relationship between the pulse disk and the home position detecting member when the rotation angle of the rotary cam starts to be detected.

FIG. 10 is a front view showing the relationship between the pulse disk 80 and the home position detecting member 81 before detection of the home position of the rotary cam 77, and FIG. 11 is a front view showing the relationship between the pulse disk 80 and the home position detecting member 81 when the rotation angle of the rotary cam 77 starts to be detected. Now, with reference to FIGS. 7 to 11, the method of detecting the home position and the cam position (rotation angle) of the rotary cam 77 will be described in detail.

The home position of the rotary cam 77 is detected in the following manner. The alignment adjustment motor 35 is driven to rotate the multiple gear 73 clockwise in FIG. 10, and this causes the pulse disk 80, which is formed integrally with the multiple gear 73, to rotate clockwise. Moreover, the double gear 75, which meshes with the multiple gear 73, rotates counter-clockwise, and thus the home position detecting member 81, which meshes with the small-diameter portion 75*b* of the double gear 75, rotates clockwise at 1/9 of the rotation speed of the multiple gear 73. That is, the home position detecting member 81 rotates in such a direction that the light-shielding portion 81*a* approaches the detecting portion 83*a* of the cam position detecting sensor 83.

Before the light-shielding portion 81*a* of the home position detecting member 81 reaches the detecting portion 83*a* of the cam position detecting sensor 83, the slits 80*a* of the pulse disk 80 pass by the detecting portion 83*a* at predetermined intervals, and thus the received signal level at the detecting portion 83*a* turns between low (OFF state) and high (ON state) at predetermined time intervals. When the home position detecting member 81 rotates until the light-shielding portion 81*a* shields the optical path of the detecting portion 83*a*, the received signal level at the detecting portion 83*a* remains low (OFF state).

Thus, stopping the driving of the alignment adjustment motor 35 when the received signal level at the detecting portion 83*a* has remained low for a predetermined period or more permits the rotary cam 77 to be positioned at the home position. Since the rotary cam 77 stops rotating a predetermined period after the light-shielding portion 81*a* has shielded the optical path of the detecting portion 83*a*, strictly speaking, the rotary cam 77 is positioned at a position rotated a predetermined amount farther from the home position. This, however, poses no problem because, as will be described later, the rotation angle of the rotary cam 77 is always detected with respect to the home position.

The rotation angle of the rotary cam 77 is detected in the following manner. In a state where the light-shielding portion 81*a* is shielding the optical path of the detecting portion 83*a*, the alignment adjustment motor 35 is rotated backward so that the multiple gear 73 is rotated counter-clockwise in FIG. 11. As a result, the double gear 75, which meshes with the multiple gear 73, rotates clockwise, and thus the home position detecting member 81, which meshes with the small-diameter portion 75*b* of the double gear 75, rotates counter-clockwise at 1/9 of the rotation speed of the multiple gear 73. That is, the home position detecting member 81 rotates in such a direction that the light-shielding portion 81*a*, which has been shielding the optical path of the detecting portion 83*a*, opens the optical path. Moreover, the double gear 75 rotates clockwise in FIG. 8, and thus the diameter of the part of the rotary cam 77 where it makes contact with the cam hole 45 of the arm member 40 gradually increases.

Here, as shown in FIG. 11, the phase of the pulse disk 80 and the home position detecting member 81 are so adjusted that, when the light-shielding portion 81*a* opens the optical path of the detecting portion 83*a*, one of the slits 80*a* of the pulse disk 80 (here, the slit 80*a*) passes by the optical path of the detecting portion 83*a*. Thus, by taking the time point at which the received signal level at the detecting portion 83*a* turns from low (OFF state) to high (ON state) as the home position and then counting the times that the received signal level turns from low to high with the passage of the slits 80*a*, it is possible to detect the rotation angle of the pulse disk 80, and to detect, based on that, the rotation angle of the rotary cam 77.

In the assembling of the cam driving mechanism 70, an adjustment pin is inserted in a phase adjustment hole 85 (phase determining means) formed in a side surface of the home position detecting member 81, and the phases of the multiple gear 73 and the home position detecting member 81 are aligned with each other so that the adjustment pin engages with a phase adjustment hole (not illustrated) formed in a side surface of the multiple gear 73. Next, the phases of the multiple gear 73 and the double gear 75 are aligned with each other so that a projection 87 (phase determining means) formed on the edge of the double gear 75 faces a recess 89 (phase determining means) formed in the rotary shaft of the multiple gear 73. In this way, assembly can be performed so that the three members, namely the rotary cam 77 (double gear 75), the pulse disk 80, and the home position detecting member 81, are previously put in predetermined phases.

With the construction described above, owing to the pulse disk 80 and the home position detecting member 81 being arranged together with the multiple gear 73, it is possible to detect the home position and the rotation angle of the rotary cam 77 with a compact construction, and to achieve space saving in the apparatus. Moreover, since the home position and the rotation angle can be detected with a single cam position detecting sensor 83, it is not necessary to provide a plurality of expensive PI sensors; this permits the use of an inexpensive DC brush motor as the alignment adjustment motor 35, and is advantageous in terms of cost as well.

Moreover, since the rotation speed of the pulse disk 80 is higher than that of the cam 77, the change of the rotation angle of the rotary cam 77 per period at which adjacent slits 80*a* of the pulse disk 80 pass by the detecting portion 83*a* is small. Thus, it is possible to enhance resolution without increasing the diameter of the pulse disk 80, and thus to detect the rotation angle of the rotary cam 77 accurately.

On the other hand, since the rotation speed of the home position detecting member 81 is lower than that of the rotary cam 77, after the light-shielding portion 81*a* of the home position detecting member 81 opens the optical path, there is no possibility of the light-shielding portion 81*a* shielding the detecting portion 83*a* again within the rotation range of the rotary cam 77. Thus, it is possible to detect the rotation angle of the rotary cam 77 accurately over its entire rotation range.

Figure 12:
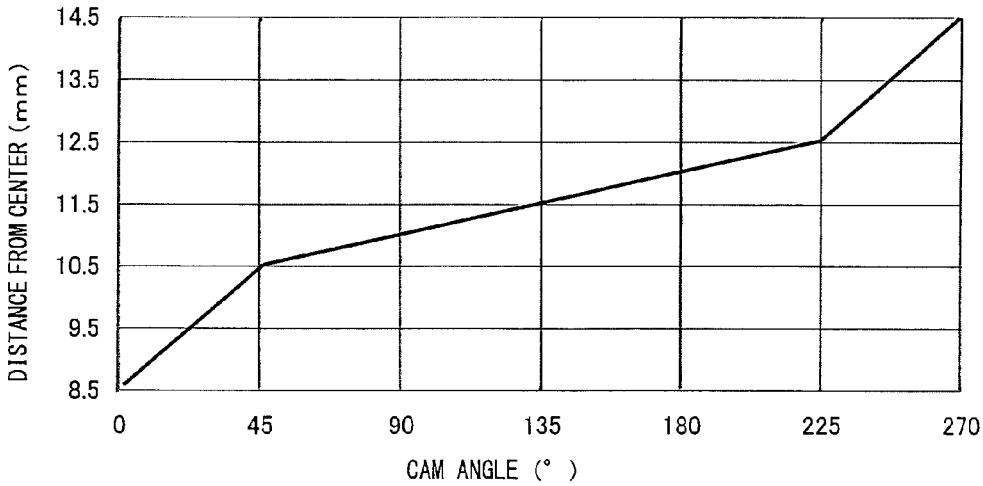
FIG. 12 is a graph showing the relationship between the rotation angle and the center-to-edge distance of the cam shown in FIG. 8.

FIG. 12 is a graph showing the relationship between the rotation angle and the center-to-edge distance of the rotary cam 77 shown in FIG. 8. As shown in FIG. 12, rotating the rotary cam 77 from its home position causes the distance from its center to edge to change at a rate of 2 mm/45° in the ranges of 0° to 45° and 225° to 270° and at a rate of 0.5 mm/45° in the range of 45° to 225°. That is, the rotary cam 77 has two regions, namely a region (hereinafter referred to as the first region) covering 45° to 225° where the amount of displacement per unit angle is constant and a region (hereinafter referred to as the second region) covering 0° to 45° and 225° to 270° where the amount of displacement per unit angle is larger than in the first region.

This construction permits the alignment adjustment width of the tension roller 11 to be switched in two steps. For example, in a case where ordinary meandering correction is performed, the range of 45° to 225° of the rotary cam 77 is used so that meandering of the intermediary transfer belt 8 can be corrected accurately. On the other hand, in a case where the belt position is outside or at the edge of the detection range of the meandering detecting sensor 21, and the alignment of the tension roller 11 needs to be changed greatly, the range of 0° to 45° or 225° to 270° is used so that, without increasing the amount of rotation of the rotary cam 77 or using an unnecessarily large-diameter rotary cam 77, the belt position can be restored to the center of the detection range.

For accurate alignment adjustment, the amount of displacement per unit angle in the first region needs to be small and constant; in contrast, no such high adjustment accuracy is required in the second region as in the first region. Accordingly, the amount of displacement per unit angle in the second region does not necessarily have to be constant. Even so, however, it is preferable to make the amount of displacement per unit angle constant also in the second region as shown in FIG. 12, because this helps simplify the rotation control of the alignment adjustment motor 35.

Figure 13:
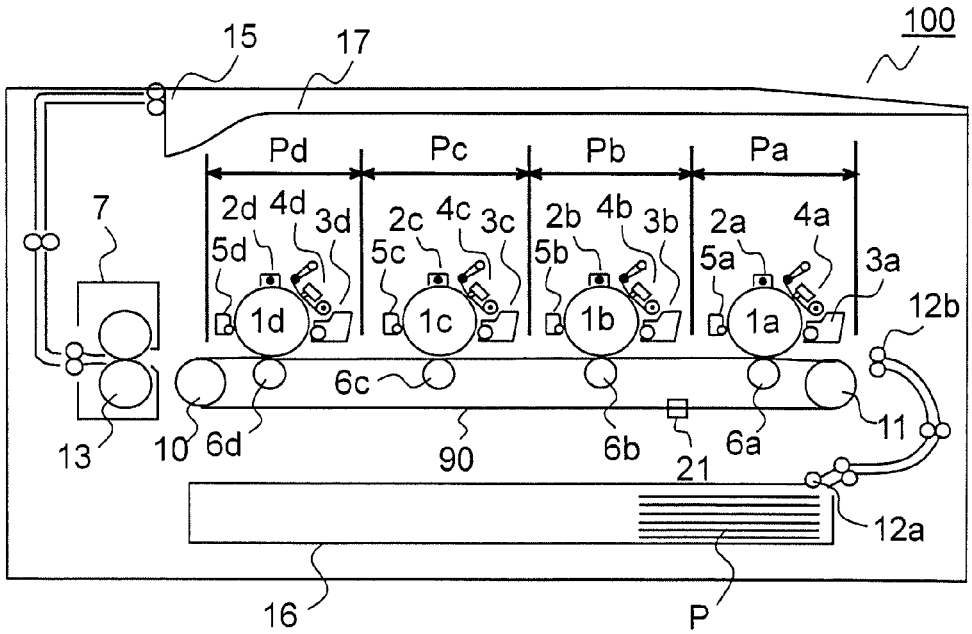
FIG. 13 is a schematic diagram showing the internal construction of an image forming apparatus according to a second embodiment which is provided with a belt transporting apparatus embodying the invention.

FIG. 13 is a schematic diagram showing the construction of an image forming apparatus according to a second embodiment which is provided with a belt transporting apparatus embodying the invention. In this embodiment, the belt transporting apparatus is used as one for transporting a transport belt 90 which transports transfer paper P across image forming sections Pa to Pd sequentially in a tandem-type color image forming apparatus of the type in which images of different colors are directly transferred onto transfer paper P. The methods of detecting and correcting meandering are quite the same as in the first embodiment, and therefore no overlapping description will be repeated.

Also in this embodiment, as in the first embodiment, it is possible to detect the home position and the rotation angle of the rotary cam 77 with a compact construction. Moreover, the home position and the rotation angle can be detected with a single cam position detecting sensor 83, and a DC brush motor can be used as the alignment adjustment motor 35. All this contributes to space saving, size reduction, and cost reduction in the belt transporting apparatus 30 and the image forming apparatus 100.

Moreover, since meandering of the transport belt 90 can be corrected accurately, it is possible to prevent misregistration when the toner images formed by the image forming sections Pa to Pd are transferred onto the transfer paper P. In particular, in a color image forming apparatus as shown in FIG. 13, it is possible to obtain satisfactory color overlay accuracy among the toner images of different colors and thereby prevent color displacement.

It should be understood that the embodiments described above are not meant to limit the present invention in any way and many modifications and variations are possible without departing from the spirit of the invention. For example, although the embodiments described above deal with examples where an optical sensor provided with a light-emitting portion and a light-receiving portion is used as the meandering detecting sensor 21, it is also possible to use instead, for example, another type of sensor such as a reflection-type sensor which irradiates the belt surface with light and measures the reflected light. It is also possible to mark the belt surface with marking for detection of meandering.

The specific shape and dimensions of the rotary cam 77 in the description above are merely an example, and the amounts of displacement per unit angle in the first and second regions may be changed to suit the alignment adjustment width and adjustment accuracy needed in meandering correction of the endless belt. For example, it is possible to make the cam driving mechanism 70 drive a linear motion cam by using a pinion and rack mechanism for alignment adjustment of belted rollers. Although the embodiments described above deal with examples where the tension roller 11 is used as the roller for alignment adjustment, it is also possible to use instead any other of the rollers around which the endless belt is wound. The alignment adjustment mechanism may be provided across a plurality of rollers.

The invention finds applications not only in tandem-type color image forming apparatuses like those in the embodiments described above but also in various image forming apparatuses employing a transport belt or an intermediary transfer belt, such as monochrome copiers, digital multifunction products (MFPs), facsimile machines, and laser printers.

On the basis of the embodiments described above, the present invention can be outlined as follows: Embodiments of the invention find applications in cam driving mechanisms used for alignment adjustment of a belt transport apparatus for rotating an endless belt such as a transport belt or an intermediary transfer belt. Using the invention makes it possible to realize a cam driving mechanism that can detect the home position and the rotation angle or moving distance of a cam with a compact construction and thereby achieve space saving in the apparatus. It is also possible to detect the home position and the rotation angle or moving distance with a single cam position detecting sensor; this eliminates the need to provide a plurality of expensive PI sensors, and is thus advantageous in terms of cost.

Moreover, by adopting a cam driving mechanism according to the invention in a belt transporting apparatus, it is possible to realize a compact belt transporting apparatus that can effectively prevent misregistration at left and right parts of a belt. In particular, using it for meandering correction of an intermediary transfer belt or transport belt in a color image forming apparatus makes it possible to realize an image forming apparatus that prevents color displacement among toner images of different colors and thereby produce a high-quality image.

What is claimed is:

1. A cam driving mechanism comprising:

a cam;

a motor which drives the cam;

a gear train which transmits, while reducing speed of, an output of the motor to the cam;

a pulse disk which is formed integrally with a gear coupled in the gear train and in which a plurality of slits are formed at equal intervals;

a home position detecting member which is arranged coaxially with the pulse disk so as to be rotatable independently thereof and which, by meshing with another gear coupled in the gear train, rotates at a lower rotation speed than the pulse disk; and a cam position detecting sensor which has a detecting portion including a light-emitting portion and a light-receiving portion, the cam position detecting sensor detecting an amount of driving of the cam based on a number of slits of the pulse disk that have passed through the detecting portion, the cam position detecting sensor detecting a home position of the cam based on timing with which the home position detecting member shields the detecting portion.

2. The cam driving mechanism according to claim 1, wherein, when the home position detecting member ceases to shield the detecting portion, one of the slits of the pulse disk passes by the detecting portion.

3. The cam driving mechanism according to claim 1, wherein the cam is rotatably supported around a fixed axis, and the cam is formed integrally with a gear which is coupled with the gear having the pulse disk formed therewith.

4. The cam driving mechanism according to claim 1, wherein the cam is formed integrally with a gear which is coupled with the home position detecting member.

5. The cam driving mechanism according to claim 4, wherein the pulse disk rotates at a higher rotation speed than the cam, and the home position detecting member rotates at a lower rotation speed than the cam.

6. The cam driving mechanism according to claim 4, wherein the pulse disk rotates at a higher rotation speed than the cam, and the home position detecting member rotates at a lower rotation speed than the cam.

7. The cam driving mechanism according to claim 3, wherein the cam has a first region where a rate of change of a center-to-edge distance thereof per unit angle is constant and a second region where the rate of change is higher than in the first region.

8. A belt transporting apparatus comprising:

an endless belt;

a plurality of belted-rollers including a tension roller which applies a predetermined tensile force to the endless belt and a drive roller which applies a rotating force to the endless belt;

meandering detecting means for detecting meandering of the endless belt; and an alignment adjustment mechanism which, based on a result of detection by the meandering detecting means, adjusts inclination of one or more of the belted rollers to correct meandering of the endless belt, wherein the alignment adjustment mechanism swings one end of the one or more of the belted rollers in an obverse/reverse direction of the belt by using the cam driving mechanism according to claim 1.

9. An image forming apparatus comprising the belt transporting apparatus according to claim 8, wherein the endless belt is an intermediary transfer belt on which toner images to be transferred to a recording medium are formed sequentially over one another.

10. An image forming apparatus comprising the belt transporting apparatus according to claim 8, wherein the endless belt is a transport belt which transports a recording medium.

* * * * *